US009798349B2

(12) United States Patent
Enshaee et al.

(10) Patent No.: US 9,798,349 B2
(45) Date of Patent: Oct. 24, 2017

(54) BUTTON PRESSING DEVICE WITH MOVING PLATE AND STICKY BALL

(71) Applicant: Open Up LLC, Wood-Ridge, NJ (US)

(72) Inventors: Arash Harry Enshaee, Wood-Ridge, NJ (US); David Nazar, Paramus, NJ (US); Hamidreza Akhavan Farahani, Rutherford, NJ (US)

(73) Assignee: UNITED WELLNESS SOLUTIONS, LLC, Paramus, NJ (US)

( * ) Notice: Subject to any disclaimer, the term of this patent is extended or adjusted under 35 U.S.C. 154(b) by 322 days.

(21) Appl. No.: 14/822,314

(22) Filed: Aug. 10, 2015

(65) Prior Publication Data

US 2017/0045907 A1 Feb. 16, 2017

(51) Int. Cl.

| | |
|---|---|
| ***G05G 1/02*** | (2006.01) |
| ***H01H 9/02*** | (2006.01) |
| ***G07C 9/00*** | (2006.01) |

(52) U.S. Cl.

CPC ..... *G05G 1/02* (2013.01); *G07C 9/00944* (2013.01); *H01H 9/0235* (2013.01)

(58) Field of Classification Search

CPC ..... G05G 1/02; H01H 9/0235; G07C 9/00944

See application file for complete search history.

(56) References Cited

U.S. PATENT DOCUMENTS

2002/0123381 A1* 9/2002 Akeripa ..... A63F 13/02 463/26

* cited by examiner

*Primary Examiner* — Robert Deberadinis

(74) *Attorney, Agent, or Firm* — Michael J. Feigin, Esq.; Feigin & Fridman

(57) ABSTRACT

A resilient ball is placed on a button to be pressed. The ball rises above the rest of the surface of a device with a button, so that a plate which pushes down on the device presses first against the ball, and presses the button there-beneath. A user can place the ball on a button of his/her choice and insert it in a housing, so that, when the plate is pushed downward, it will, in turn, cause the chosen button to be pressed. The plate is held with a dowel on one end, extending past the plate thereof at another end and into portals which are part of, or fixed to, the housing. The compressible ball is thus positioned between the plate and the button to be pressed, the device abutting the housing and/or a fixed plate on its other side.

17 Claims, 6 Drawing Sheets

BUTTON PRESSING DEVICE WITH MOVING PLATE AND STICKY BALL

This application incorporates by reference U.S. patent application Ser. No. 14/822,084 entitled Double Wireless Receipt and Transmission with Mechanical Movement Causing Second Wireless Transmission having a filing date of Aug. 10, 2015, having the same inventors as the present application.

FIELD OF THE DISCLOSED TECHNOLOGY

The disclosed technology relates generally to button pressing and, more specifically, to pressing buttons by pressing a plate against a ball into a button.

BACKGROUND OF THE DISCLOSED TECHNOLOGY

Remote controls are ubiquitous. Such devices transmit a signal wirelessly using infrared, radio frequency, or otherwise, to a receiver. They are used for various receiving devices, including televisions, garage doors, gates, cars, and even window shades, as well as model craft. They work well, but require specialized devices which transmit particular encoded data. The easiest way to operate a receiving device, for a consumer, is simply to use the remote control provided by the manufacturer or retailer.

While programmable devices exist, these too are standalone devices which require manual button presses to operate. Still further, it is not always possible to copy the transmitted signal, as manufacturers may encrypt or distort the transmission in a way that changes each time or requires a particular piece of hardware. Third party remote control is discouraged, difficult, or simply not worth the expense.

The problem is that current remotes are each proprietary in size, shape, and codes transmitted. In order to create a truly universal remote, one would need to be able to transmit infrared, radio frequency (RF), and have buttons Which are equally easy to use as remote control, while coding for many different remote controls being used in one interface. There exists a need in the art to be able to operate such remotes from a common interface while retaining functionality, ease of producing the desired transmission, and minimum expense.

SUMMARY OF THE DISCLOSED TECHNOLOGY

Embodiments of the disclosed technology include a button-pressing kit. The kit has a fixed plate which abuts a transmitter device. A "plate" is defined as a rigid length of material having an elongated length extending further than any other dimension of the material. The transmitter device has a depressible button on an exterior surface thereof. The transmitter can be a remote control and may have more than one depressible button. The "button," for purposes of this disclosure, is a mechanical button which activates an electrical switch being depressed. "Depressed," for purposes of this specification, is movement of a button, such that an electrical gate is opened or closed (e.g., switched on or off), activating transmission of a radio, light, or other signal. A resilient ball abuts the button and extends above a plane defined by outermost extents of the exterior surface of the transmitter device. "Resilient" is defined as "above to be deformed by pressure and substantially and repeatedly return to its original shape." An axially rotating plate abuts the resilient ball.

Axial rotation (rotating around an axis) in a first direction depresses the button, based on pressure applied by the resilient ball against the button. A motor can cause this axial rotation. However, upon the pressure being too great (e.g., resistance on the motor determined), the button can be considered "depressed," and the motor can rotate in the other direction, sending the movable plate back to a starting point.

In order to depress the button, a specific input may be required, such as on a tactile sensor. This input may be a code entered based on placement and quantity of taps on a housing or a larger structure (such as a car) in which the devices are kept.

The resilient ball can stick to the button (have adhesive connection) and lacks sticking ability with respect to the axially rotating plate (lacks adhesive connection).

More specifically, an embodiment of the disclosed technology can have a compressible ball (defined as "able to be compressed to less than 80% of its non-compressed size while still returning to it's original size), a plate with dowel extending past the plate at a first end, and a housing with portals holding the dowel on either end of the dowel. The compressible ball is positioned between the plate and a device with a button, the device with a button abutting the housing (on the inside or outside of the housing). The compressible ball and the button can be removably and/or adhesively connected. A motor can be mechanically engaged with the plate at a second end, the second end being at an opposite side from the first end. One "side" is differentiated from another by way of a midpoint halfway between the extreme ends. An "end" is defined as between an edge and 20% of the distance from end to end. An "extreme end" is defined as no more than 3% of the distance from the edge of the respective side to the other edge on the opposite side.

A spin of the motor in a first direction causes the dowel to rotate and compress the compressible ball against the button, whereas a spin in a second opposite direction causes the dowel to rotate away from the button, pulling the plate away from the button as well. This spin/rotating can be activated based on a sequence of pressure placed on the housing directly, or through another object, such as the exterior of a car or windshield.

The same concept is also described with respect to its method of use. A button-pressing method is carried out by way of adhering a compressible or resilient ball on a button of a remote control (a type of transmitter designed to act on another object from a distance via wireless transmission of data), placing the remote control between a housing and a rotatable plate, and rotating the rotatable plate towards the remote control at least until the button is pressed. The ball extends above a plane defined by outermost extents of an exterior surface of the remote control. Receipt of a specific tactile input pattern or a remote transmission (different from the transmission of the remote control/transmitter) can cause the rotating. When a tactile input pattern is used, this can be on an exterior of a car causing the button to be pressed and the car to be unlocked.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

Embodiments of the disclosed technology have a compressible or resilient ball (which can be of any shape, such as spherical, conical, prism, cylindrical, etc.). This ball is placed on a button to be pressed, such as on a remote control or transmitter. The ball rises above the rest of the surface of the remote control or transmitter, and, as such, an item pressing down along the surface will contact and press the ball and, therefore, the button beneath it, before any other item on the surface of the remote control or transmitter. As such, a plate is used for this pushing, allowing a user to place the ball on a button of his/her choice and insert it in a housing, so that, when the plate is pushed downwards, it will, in turn, cause the chosen button to be pressed. The plate is held with a dowel on a first end, extending past the plate (meaning, the flat elongated side) thereof at a second end, and into portals which are part of, or fixed to, the housing. The compressible ball is thus positioned between the plate and the button to be pressed, the device abutting the housing and/or a fixed plate on its other side. A motor is activated to push the plate down at an angle (or transverse to the button, bottom of the housing, or top of the housing) to activate the button.

Embodiments of the disclosed technology will become clearer in view of the following description of the drawings.

Figure 1:
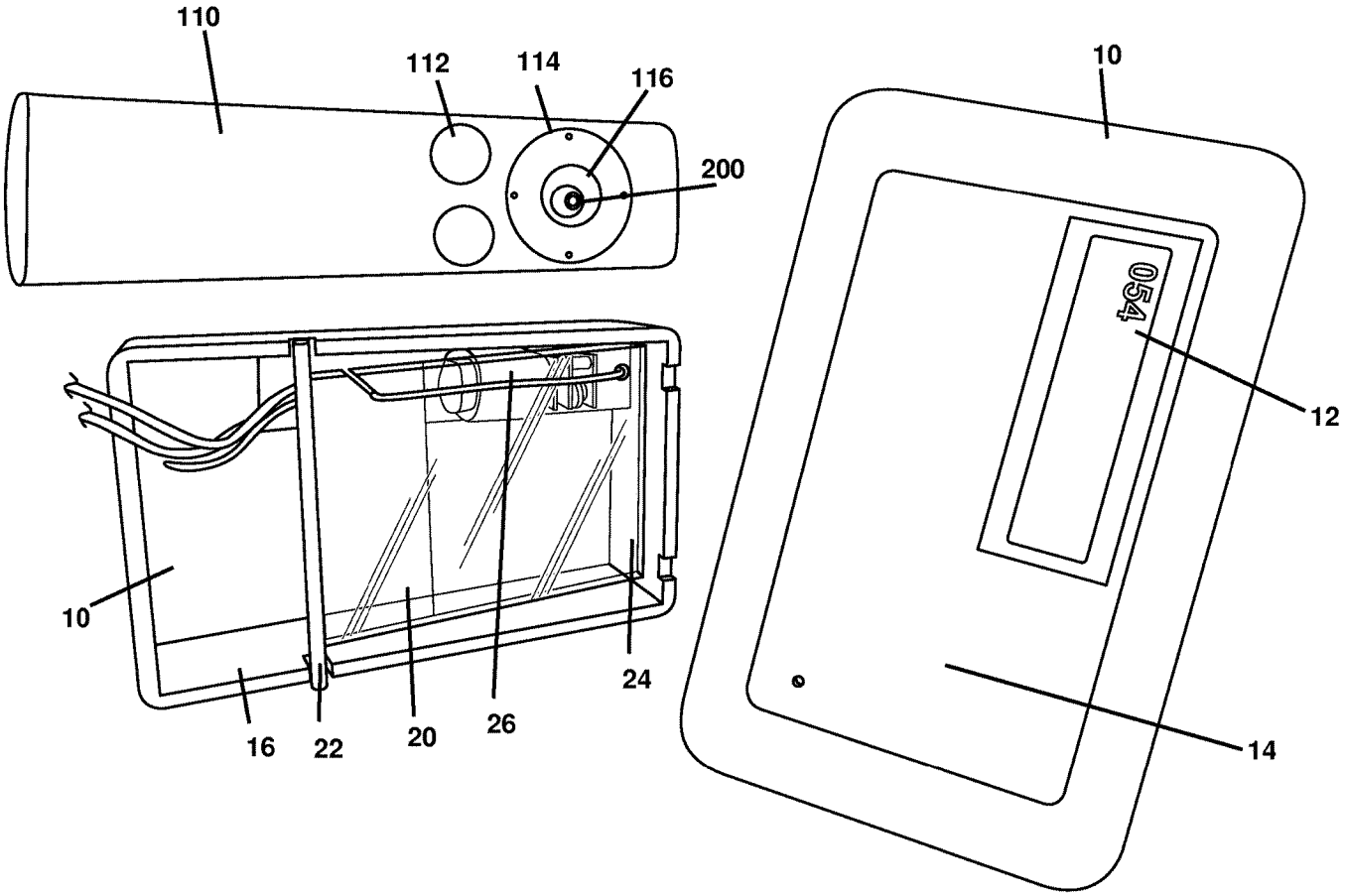
FIG. 1 shows, at a high level, devices which are used to carry out embodiments of the disclosed technology.

FIG. 1 shows, at a high level, devices which are used to carry out embodiments of the disclosed technology. A remote control or transmitter 110 is shown with buttons 112, 114, and 116. A resilient ball 200 is placed on any one of the buttons. In this manner, a person chooses which button he/she wishes to be pressed by other devices of the disclosed technology, because the button 200 rises above the plane of the exterior of the transmitter. That is, the transmitter has a top plane defined by its top surface (a surface with pressable buttons which are activated by pushing the button inwards, towards an interior of the transmitter device). These buttons are switches which are activated based on pressure. By placing the resilient ball 200 on a button (here, on button 116) it is now "higher" or further from the surface defined by the other buttons and same side of the transmitter 110. The exterior plane of the device is defined by taking a theoretically perfectly rigid material of a theoretically infinitely small width and leaning it against one side of the transmitter (or other device) and placing such a device against a side of the transmitter. This plane now forms the exterior plane of the device on the side on which it leans, a side being one of the cardinal sides, in three dimensions, of the product, such as the top side, button side, left side, right side, front side, or rear side. An exterior side is a planar side of the device (at least 50% of the side lying in the same plane).

The transmitter, such as transmitter 110, is then placed within a housing 10 having a rigid back wall or plate and rotatable/movable plate 20. By way of a motor 26 or other movement device, the movable plate 20 is rotated about an axis defined by a dowel 22 which fits within slots of the side walls 16 of the housing 10. A far end 24 of the movable plate 20 then moves downwards, applying pressure on the resilient ball 200. A cover or front panel 14 of the housing 10 can have a display 12. The cover 14 can have sensors which sense touch or vibration, in order to determine that a code or pattern has been made there-on to cause the button (e.g., button 116) to be pressed by the downward rotation of the movable plate 20. The display 12 can update as the code or pattern is entered, to show the present status of the code entered.

Figure 2:
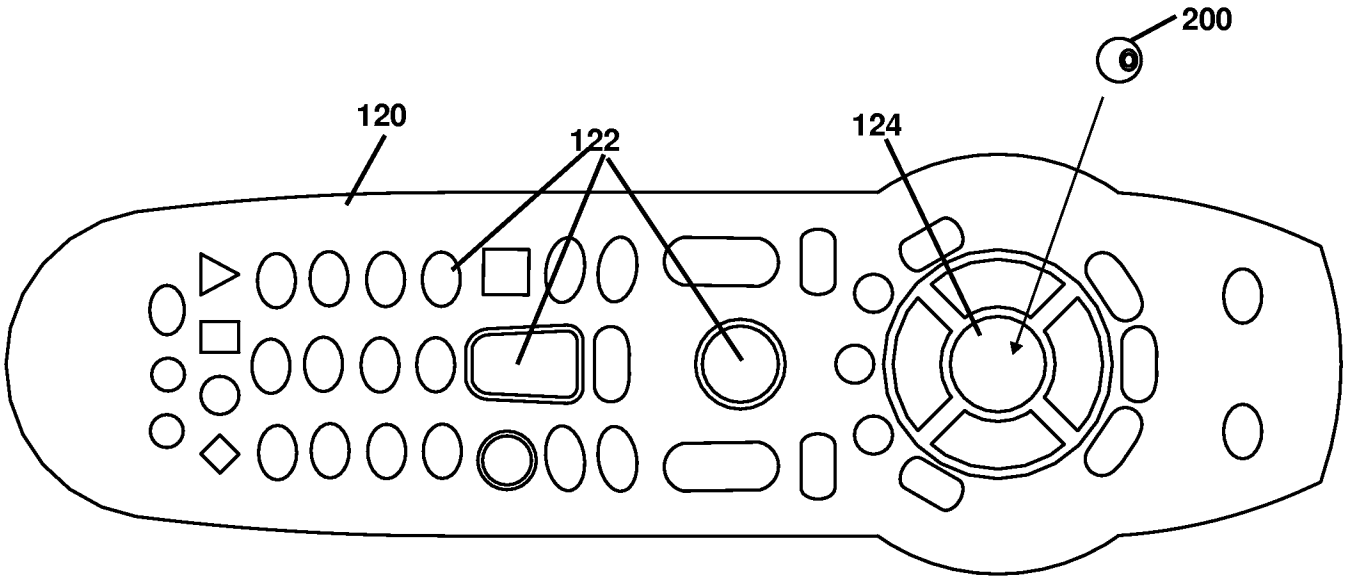
FIG. 2 shows buttons on a transmitter device with placement of a resilient ball, used in embodiments of the disclosed technology.

FIG. 2 shows buttons on a transmitter device with placement of a resilient ball, used in embodiments of the disclosed technology. Here, the transmitter is a television remote control with a front surface 120, an example of an exterior surface, with buttons 122 and 124, which rise above the exterior surface and form the uppermost extents of an exterior plane. Thus, the exterior plane passes over the tops of the buttons 122 and 124. The resilient ball 200 then rises above this exterior plane. As such, a movable plate rotating or moving downward towards the front exterior surface 120 of the remote control will be stopped when hitting the resilient ball 200, pressing the ball into the button 124, causing it to be pressed. A user can place the resilient ball on any of the buttons of the transmitter which are to be pressed, as the resilient ball 200, wherever it may be located, will be the highest point with reference to this exterior side of the transmitter. This is true even if the buttons 122 and 124 are recessed into the transmitter surface 120, as long as the resilient ball rises above the planar front surface 120.

Figure 3:
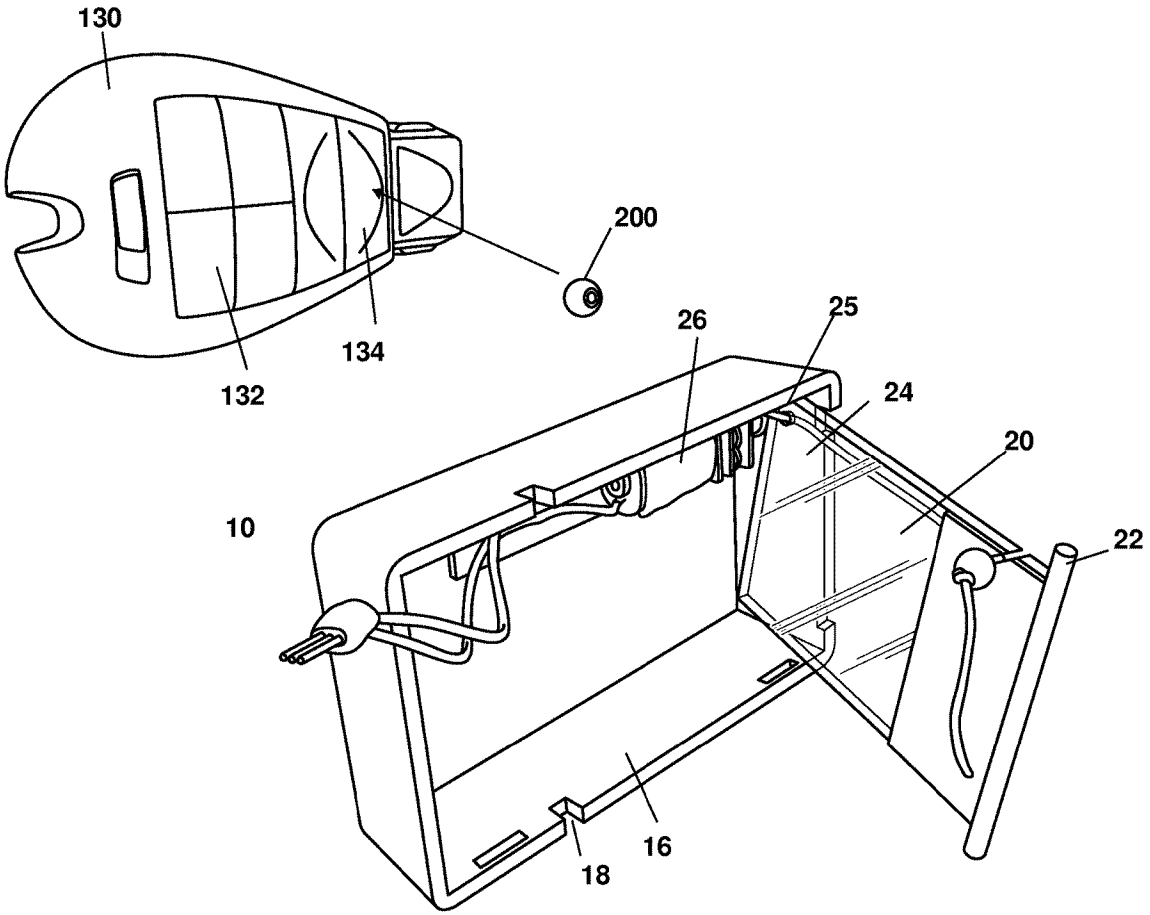
FIG. 3 shows a different transmitter device with resilient ball and plate spaced apart from one another, in an embodiment of the disclosed technology.

FIG. 3 shows a different transmitter device with resilient ball and plate spaced apart from one another, in an embodiment of the disclosed technology. Here, a transmitter has a front surface 130 with various buttons 132 and 134. The resilient ball 200 is placed on a button 134. The front surface 130 is curvilinear; however, the resilient ball 200 rises above an exterior plane placed against it, due to the downward angle of the surface, such that, when placed in the housing 10 in the orientation shown, the side of the movable plate 200, which moves downward (most extremely at end 24), hits into the resilient button 200 before hitting into the buttons or exterior surface 130 of the transmitter.

Referring now to the housing 10 specifically and in more detail, there are two portals 18, one in each side wall 16, which are adapted for a dowel 22. The dowel 22 has a length greater than that of the narrower plane of the rectangular-shaped movable plate 20, as well as greater than that of the housing 16. Portals for holding the dowel 22 or end of the movable plate 20 can be interior to the housing as well. The end 24 of the movable plate 20 then moves up or down, based on the rotation of the motor 26, which is translated by way of gearing known in the order into up/down motion at a contact point near the extreme end 25 of the movable plate 20. Thus, one end of the plate 30 remains at a constant height, in embodiments of the disclosed technology, while the other end 25 moves downwards onto the resilient ball.

Once the resilient ball is pressed, it may begin to compress or may be incompressible by way of the forces placed against it by the movable plate 20. Upon (further) pressing, the side of the ball 200 adjacent to the button (e.g., button 134) is moved downwards, causing the button 134 to move. Once resistance is above a certain level, the downward movement of the movable plate 20 is ceased, and it moves back upwards to a resting position, above the transmitter 130 and resilient ball 200. In the resting position, the movable plate 20 is spaced apart from the resilient ball 200 and transmitter 130.

Discussing now the resilient ball 200 specifically, the ball can have adhesive properties, allowing it to be placed on or against a button and adhere-thereto. A separate adhesive may be used (such as tape or even glue), but in embodiments, the surface or surface coating of the ball, or at least a single side of the ball, is "sticky" (defined as, "designed to stick to things on contact"). The side opposite the side with adhesive quality ("sticky") can be non-adhesive ("non-sticky") with reference to its ability to stick to the moving plate 20, such as a glass or plastic plate, which can be coated with a non-stick coating, or have a surface that does not adhere to the resilient ball 200. Still further, only one side of the ball 200 has adhesive qualities in embodiments of the disclosed technology, whereas the other side is smooth and/or non-sticky. One can stick the ball to a button only with one side (the sticking/adhesive side,) while the remaining portions of the exterior of the resilient ball 200 do not stick. The ball 200 can have a flat bottom which is sticky, while a remaining, generally spherical, portion and/or top flat side lacks sticky qualities.

Figure 4:
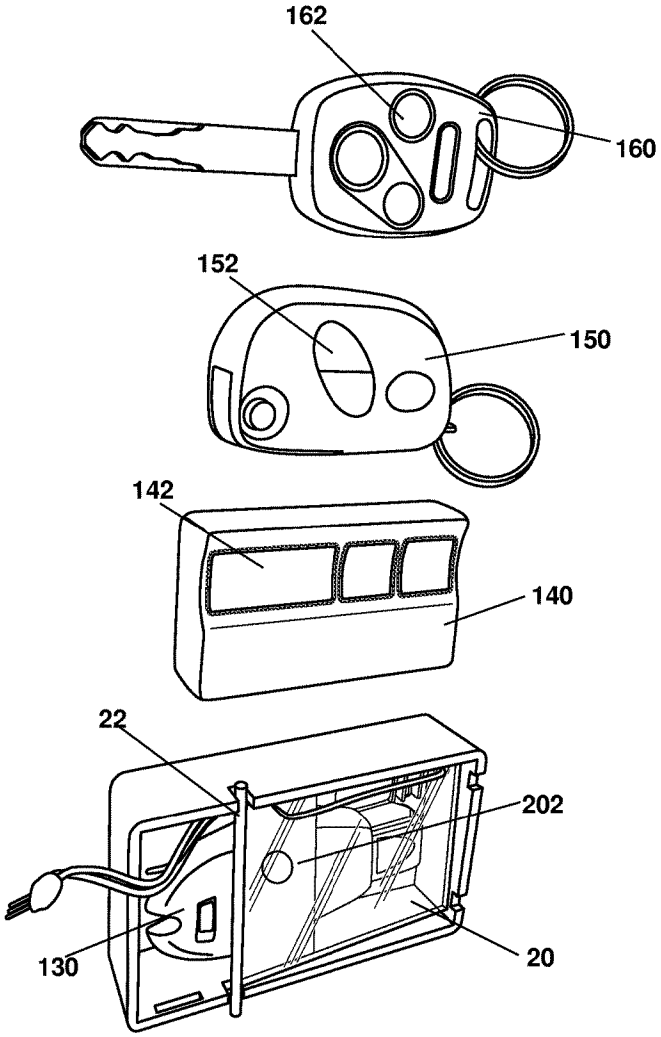
FIG. 4 shows further examples of transmitting devices used in embodiments of the disclosed technology, as well as the transmitter device of FIG. 4 placed within a housing with rotating plate.

FIG. 4 shows further examples of transmitting devices used in embodiments of the disclosed technology, as well as the transmitter device of FIG. 4 placed within a housing with a rotating plate. Any one of a key 160 with button 162 (such as for a car), key-chain garage door opener 150 with button 152, full size garage door opener 140 with button 142 can be used with embodiments of the disclosed technology, by way of example. The transmitter 130 is shown in the housing 10 with the resilient ball 200 placed below the circle 202 shown on the movable plate 20. When the movable plate is moved down, the resilient ball 200 extends about the exterior surface defined by its adjacency to the path of the movable plate 20. As such, the movable plate 20 hits into the resilient ball, pushing down a button there-beneath.

Figure 5:
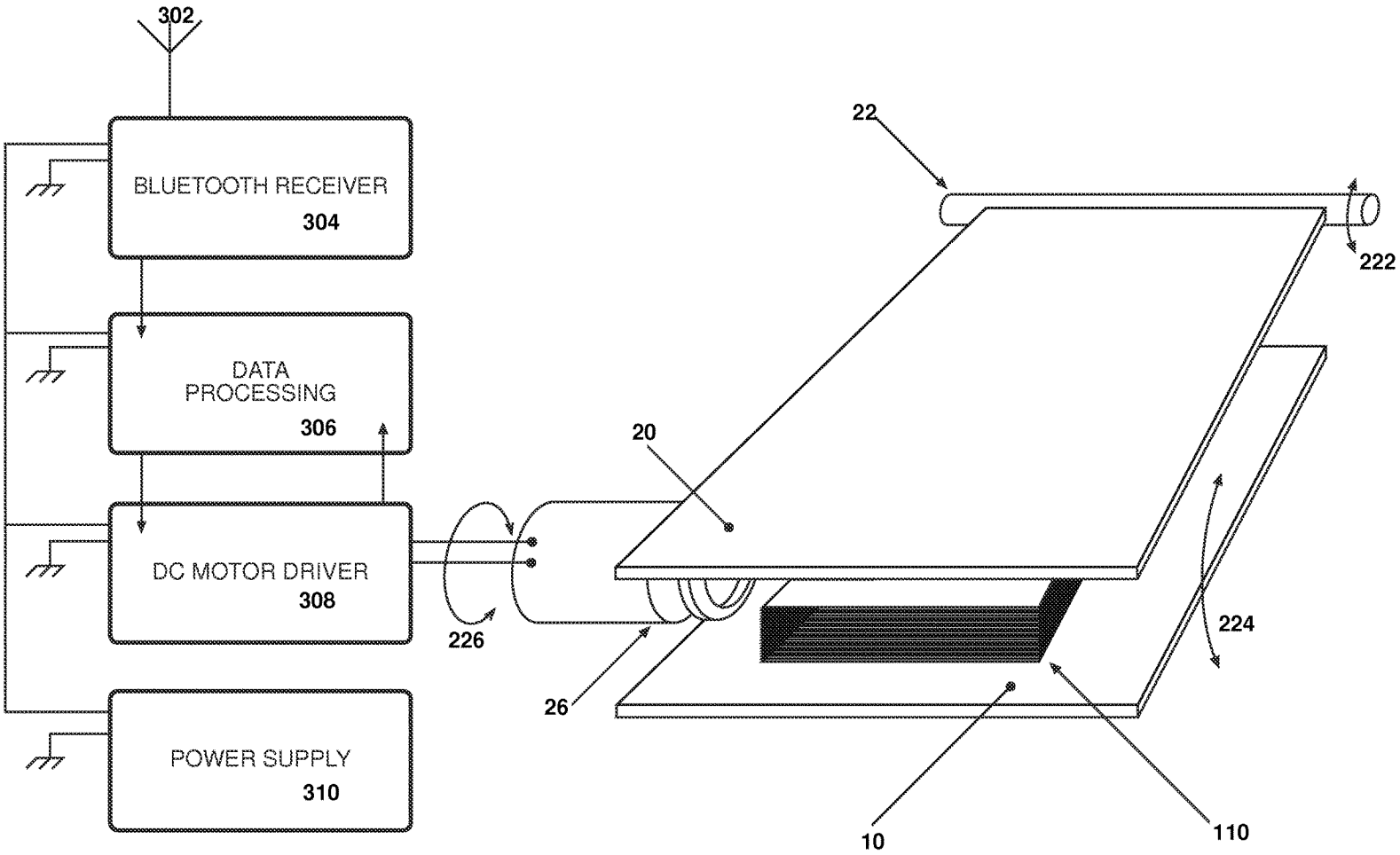
FIG. 5 shows plates and accompanying control units used by depressing a button of a transmitter, in an embodiment of the disclosed technology.

FIG. 5 shows plates and accompanying control units used to depress a button of a transmitter, in an embodiment of the disclosed technology. Here, a BlueTooth receiver 304 or any other wireless receiver can be used to receive a signal via antenna 302. A processor, input/output, memory storage (volatile or non-volatile) is represented by the data-processing block 306. A power supply 310 powers the processor, receiver, and/or motor 26. Data is received from one or more inputs, such as a remote device transmitting a code or a sensor detecting movement or key presses on a surface of the device (see FIG. 1). The data processing block 306 determines when to operate the DC motor driver 308 to turn the shaft of the motor 26 in the direction indicated by arrow 226. This circular motion of the motor shaft, in turn, raises and lowers the movable plate 20 in the direction 224. The plate 10, which can also be the back of the housing 10 shown in earlier figures, is held in place with respect to the transmitter device 110 shown there-on, as well as the motor 26. The plate 20 rises, also spinning the dowel 22 in the direction 222. The plate 20 starts in a resting position above the transmitter 110 and the resilient ball adjacent there-to. The plate 20 is then lowered until it presses into the resilient ball 200 and, in turn, a button on the transmitter 110 is pressed.

Figure 6:
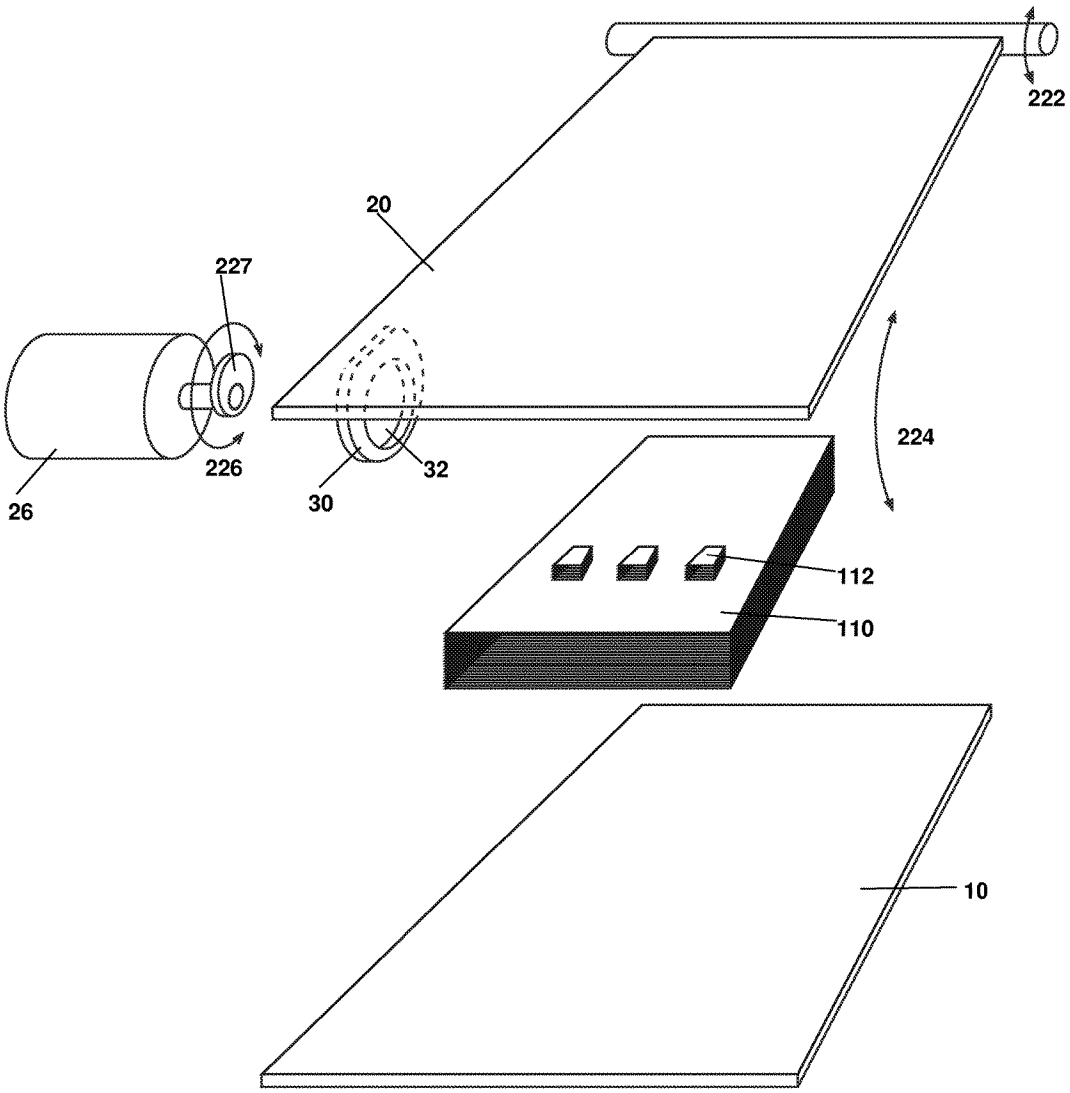
FIG. 6 shows a spaced-apart version of the devices shown in FIG. 5.

FIG. 6 shows a spaced-apart version of the devices shown in FIG. 5. Here, one can see the gearing 227 on the end of the motor 26. When the gear 227 turns, it moves gear 30 (fixedly attached to plate 20) by way of the portal 32 of the gear 30 which gear 227 fits within. This raises and lowers the plate 20 in the 224 direction, while the dowel further moves in direction 222. When moving down, it presses against a button 112 or a plurality thereof. By placing a resilient ball 200 above a button and adjacent or stuck there-to, the resilient ball is first pressed, causing the button on which it is placed to be activated as the motor 226 moves the plate 20 towards the transmitter.

In an embodiment, the device is placed inside a car with the housing adjacent to, or stuck to, a windshield or window. Tapping on the respective glass of the car is used to enter a code detected by a sensor within the housing, which activates the moving of the movable plate, pressing an unlock button, unlocking the car.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A button-pressing kit comprising:

a fixed plate abutting a transmitter device, said transmitter device having a depressible button on an exterior surface thereof;

a resilient ball abutting said button and extending above a plane defined by outermost extents of said exterior surface of said transmitter device;

an axially rotating plate abutting said resilient ball.

2. The button-pressing kit of claim 1, wherein axial rotation of said axially rotating plate in a first direction depresses said button based on pressure applied by said resilient ball against said button.

3. The button pressing kit of claim 2, wherein a motor causes said axial rotation and, upon determination of resistance above a pre-determined threshold, a direction of said axial rotation is reversed.

4. The button-pressing kit of claim 2, further comprising an input device requiring a specific tactile input pattern to axially rotate said plate and depress said button.

5. The button-pressing kit of claim 1, wherein said resilient ball sticks to said button and lacks sticking ability with respect to said axially rotating plate.

6. The button-pressing kit of claim 4, wherein said input device is a tap sensor, and said tactile input pattern is on a surface of housing, said housing holding said movable plate, said fixed plate, and said transmitter.

7. A button-pressing system comprising:

a compressible ball;

a plate with dowel extending past the plate at a first end;

a housing with portals holding said dowel on either end thereof;

wherein said compressible ball is positioned between said plate and a device with a button, said device with a button abutting said housing.

8. The button-pressing system of claim 7, wherein said compressible ball and said button are removably and adhesively connected.

9. The button-pressing system of claim 8, further comprising a motor mechanically engaged with said plate at a second end, said second end being at an opposite side from said first end.

10. The button-pressing system of claim 9, wherein a spin of said motor in a first direction causes said dowel to rotate and compress said compressible ball against said button.

11. The button-pressing system of claim 10, wherein a spin of said motor in a second direction causes said dowel to rotate in an opposite direction from said rotation of claim 10 and move said plate away from said button.

12. The button-pressing system of claim 10, wherein said spin of said motor is activated based on a sequence of pressure placed on said housing.

13. The button-pressing system of claim 12, wherein said housing is located inside a car, said button unlocks said car, and said pressure is applied on an exterior of said car.

14. A button-pressing method carried out by way of:

adhering a compressible or resilient ball on a button of a remote control;

placing said remote control between a housing and a rotatable plate;

rotating said rotatable plate towards said remote control at least until said button is pressed.

15. The button-pressing method of claim 14, wherein said ball extends above a plane defined by outer-most extents of an exterior surface of said remote control.

16. The button-pressing method of claim 15, wherein receipt of a specific tactile input pattern causes said rotating.

17. The button-pressing method of claim 16, wherein said tactile input pattern is on an exterior of a car, causing said button to be pressed and said car to be unlocked.

* * * * *